US010810958B2

(12) United States Patent
Shen et al.

(10) Patent No.: US 10,810,958 B2
(45) Date of Patent: Oct. 20, 2020

(54) DISPLAY PANEL AND DRIVE METHOD THEREOF, AND DISPLAY DEVICE

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Lixia Shen, Beijing (CN); Zhiguang Zhang, Beijing (CN); Chang Zhang, Beijing (CN); Yong Yu, Beijing (CN); Tae Hyun Kim, Beijing (CN)

(73) Assignees: CHENGDU OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/336,989

(22) PCT Filed: Aug. 31, 2018

(86) PCT No.: PCT/CN2018/103506
§ 371 (c)(1),
(2) Date: Mar. 27, 2019

(87) PCT Pub. No.: WO2019/042405
PCT Pub. Date: Mar. 7, 2019

(65) Prior Publication Data

US 2020/0035174 A1 Jan. 30, 2020

(30) Foreign Application Priority Data

Sep. 4, 2017 (CN) ..... 2017 1 0785928

(51) Int. Cl.
*G09G 3/36* (2006.01)
*G09G 3/3225* (2016.01)

(52) U.S. Cl.
CPC ..... *G09G 3/3648* (2013.01); *G09G 3/3225* (2013.01); *G09G 2310/0243* (2013.01); *G09G 2310/0264* (2013.01)

(58) Field of Classification Search
CPC combination set(s) only.
See application file for complete search history.

(56) References Cited

U.S. PATENT DOCUMENTS 10,210,800 B2 * 2/2019 Gu ..... G02F 1/133514
10,235,946 B2 * 3/2019 Zhang ..... G09G 3/3426
(Continued)

FOREIGN PATENT DOCUMENTS

CN 102930840 A 2/2013
CN 104821147 A 8/2015
(Continued)

OTHER PUBLICATIONS

PCT International Search Report, Application No. PCT/CN2018/103506, dated Nov. 28, 2018, 6 pages: with English translation.
(Continued)

*Primary Examiner* — Van N Chow
(74) *Attorney, Agent, or Firm* — Armstrong Teasdale LLP

(57) ABSTRACT

Embodiments of the present disclosure provide a display panel and a drive method thereof, and a display device. The display panel includes a plurality of sets of pixel columns and a plurality of drive circuits. Each of the sets of pixel columns includes a plurality of subpixel columns. The plurality of drive circuits correspond to the plurality of sets of pixel columns respectively. Each of the drive circuits is further configured to send, to an adjacent drive circuit, a source data signal for the subpixel column in the set of pixel columns of the drive circuit, and/or receive, from the adjacent drive circuit, a source data signal for the subpixel column in the set of pixel columns of the adjacent drive
(Continued)

circuit and generate a data signal for driving the subpixel column in the set of pixel columns of the drive circuit, based on the received source data signal.

18 Claims, 2 Drawing Sheets

(56) References Cited

U.S. PATENT DOCUMENTS

| | | | | |
|---|---|---|---|---|
| 10,269,308 | B2 * | 4/2019 | Yang | G09G 3/3426 |
| 10,410,602 | B2 * | 9/2019 | Wang | G09G 3/20 |
| 10,431,148 | B2 * | 10/2019 | Kim | G09G 3/2003 |
| 10,522,081 | B2 * | 12/2019 | Kim | G09G 3/3233 |
| 2004/0140983 | A1 | 7/2004 | Credelle | |
| 2014/0043311 | A1 * | 2/2014 | Shao | G09G 3/36 345/209 |
| 2014/0347256 | A1 | 11/2014 | Sato et al. | |
| 2015/0339967 | A1 * | 11/2015 | Shin | G06F 3/1446 345/690 |
| 2019/0180696 | A1 * | 6/2019 | Park | H01L 27/322 |

FOREIGN PATENT DOCUMENTS

| | | | |
|---|---|---|---|
| CN | 105161059 | A | 12/2015 |
| CN | 105405392 | A | 3/2016 |
| CN | 106415697 | A | 2/2017 |
| CN | 107507551 | A | 12/2017 |
| JP | 2012022186 | A | 2/2012 |

OTHER PUBLICATIONS

PCT Written Opinion, Application No. PCT/CN2018/103506, dated Nov. 28, 2018, 5 pages.: with English translation of relevant part.
China First Office Action, Application No. 201710785928.9, dated Apr. 24, 2019, 10 pps.: with English translation.

* cited by examiner

DISPLAY PANEL AND DRIVE METHOD THEREOF, AND DISPLAY DEVICE

CROSS REFERENCE TO RELATED APPLICATIONS

This patent application is a National Stage Entry of PCT/CN2018/103506 filed on Aug. 31, 2018, which claims the benefit and priority of Chinese Patent Application No. 201710785928.9 filed on Sep. 4, 2017, the disclosures of which are incorporated by reference herein in their entirety as part of the present application.

BACKGROUND

The present disclosure relates to the field of display technologies, and more particularly, to a display panel and a drive method thereof, and a display device.

At present, display technologies are widely used in television, mobile phones, and public information display. Flat panel displays for displaying are promoted vigorously due to their ultra-thin and energy-saving advantages. Generally, large-sized display devices are used in digital display screens for advertisement information display or digital signage display screens, etc.

BRIEF DESCRIPTION

Embodiments of the present disclosure provide a display panel and a drive method thereof, and a display device.

A first aspect of the present disclosure provides a display panel. The display panel includes a plurality of sets of pixel columns and a plurality of drive circuits. Each of the sets of pixel columns includes a plurality of subpixel columns, each of the subpixel columns includes a plurality of subpixel units, and each of the subpixel units includes at least two subpixels configured to display different colors. A plurality of drive circuits correspond to the plurality of sets of pixel columns respectively and are configured to drive the respective sets of pixel columns to display. Each of the drive circuits is further configured to send, to an adjacent drive circuit, a source data signal for the subpixel column in the set of pixel columns of the drive circuit which is adjacent to the set of pixel columns of the adjacent drive circuit, and/or receive, from the adjacent drive circuit, a source data signal for the subpixel column in the set of pixel columns of the adjacent drive circuit which is adjacent to the set of pixel columns of the drive circuit, and generate a data signal for driving the subpixel column in the set of pixel columns of the drive circuit which is adjacent to the set of pixel columns of the adjacent drive circuit, based on the received source data signal.

In some embodiments of the present disclosure, the drive circuit is further configured to send, when driving the last subpixel column in the set of pixel columns of the drive circuit, the source data signal for the last subpixel column to the next adjacent drive circuit, and/or receive, when the last subpixel column in the set of pixel columns of the previous adjacent drive circuit is being driven, a source data signal for the last subpixel column in the set of pixel columns of the previous drive circuit from the previous adjacent drive circuit, and generate a data signal for driving the first subpixel column in the set of pixel columns of the drive circuit based on the received source data signal.

In some embodiments of the present disclosure, the drive circuit is further configured to receive, when driving the penultimate subpixel column in the set of pixel columns of the drive circuit, a source data signal for the first subpixel column in the set of pixel columns of the next adjacent drive circuit from the next adjacent drive circuit, and generate a data signal for driving the last subpixel column in the set of pixel columns of the drive circuit based on the received source data signal, and/or send, when the penultimate subpixel column in the set of pixel columns of the previous adjacent drive circuit is being driven, a source data signal for the first subpixel column in the set of pixel columns of the drive circuit to the previous adjacent drive circuit.

In some embodiments of the present disclosure, the drive circuit includes at least one serial communication interface. The source data signal is transmitted between the drive circuits adjacent to each other via the serial communication interface.

In some embodiments of the present disclosure, the drive circuit further includes a line buffer. The line buffer is configured to store the source data signal received via the serial communication interface.

In some embodiments of the present disclosure, each of the subpixel units in one of the adjacent subpixel columns includes a red subpixel and a green subpixel, and each of the subpixel units in the other one of the adjacent subpixel columns includes a blue subpixel and a green subpixel.

A second aspect of the present disclosure provides a method for driving the display panel according to the first aspect of the present disclosure. According to this method, for each of a plurality of drive circuits, the drive circuit sends, to an adjacent drive circuit, a source data signal for the subpixel column in the set of pixel columns of the drive circuit which is adjacent to the set of pixel columns of the adjacent drive circuit, and/or the drive circuit receives, from the adjacent drive circuit, a source data signal for the subpixel column in the set of pixel columns of the adjacent drive circuit which is adjacent to the set of pixel columns of the drive circuit, and generates a data signal for driving the subpixel column in the set of pixel columns of the drive circuit which is adjacent to the set of pixel columns of the adjacent drive circuit, based on the received source data signal.

In some embodiments of the present disclosure, sending, by the drive circuit, a source data signal for the subpixel column in the set of pixel columns of the drive circuit which is adjacent to the set of pixel columns of an adjacent drive circuit to the adjacent drive circuit includes sending, by the drive circuit, when driving the last subpixel column in the set of pixel columns of the drive circuit, the source data signal for the last subpixel column to the next adjacent drive circuit, and/or sending, by the drive circuit, when the penultimate subpixel column in the set of pixel columns of the previous adjacent drive circuit is being driven, a source data signal for the first subpixel column in the set of pixel columns of the drive circuit to the previous adjacent drive circuit.

In some embodiments of the present disclosure, receiving, by the drive circuit, a source data signal for the subpixel column in the set of pixel columns of the adjacent drive circuit which is adjacent to the set of pixel columns of the drive circuit from the adjacent drive circuit, and generating a data signal for driving the subpixel column in the set of pixel columns of the drive circuit which is adjacent to the set of pixel columns of the adjacent drive circuit, based on the received source data signal include receiving, by the drive circuit, when driving the penultimate subpixel column in the set of pixel columns of the drive circuit, a source data signal for the first subpixel column in the set of pixel columns of the next adjacent drive circuit from the next adjacent drive circuit, and generating a data signal for driving the last subpixel column in the set of pixel columns of the drive circuit based on the received source data signal, and/or receiving, by the drive circuit, when the last subpixel column in the set of pixel columns of the previous adjacent drive circuit is being driven, a source data signal for the last subpixel column in the set of pixel columns of the previous drive circuit from the previous adjacent drive circuit, and generating a data signal for driving the first subpixel column in the set of pixel columns of the drive circuit based on the received source data signal.

In some embodiments of the present disclosure, the source data signal is transmitted between the drive circuits adjacent to each other via a serial communication interface.

In some embodiments of the present disclosure, the source data signal is transmitted between the drive circuits adjacent to each other via the serial communication interface under the control of a line synchronization signal.

A third aspect of the present disclosure provides a display device. The display device includes the display panel according to the first aspect of the present disclosure.

BRIEF DESCRIPTION OF THE DRAWINGS

To describe the technical solutions of the present disclosure more clearly, the accompanying drawings of the embodiments will be briefly introduced below. It is to be known that the accompanying drawings in the following description merely involve with some embodiments of the present disclosure, but not limit the present disclosure. In the drawings.

DETAILED DESCRIPTION

To make the technical solutions and advantages of the embodiments of the present disclosure clearer, the technical solutions of the embodiments of the present disclosure will be clearly and completely described below with reference to the accompanying drawings. Apparently, the described embodiments are merely some but not all of the embodiments of the present disclosure. All other embodiments obtained by those of ordinary skill in the art based on the described embodiments without creative efforts shall fall within the scope of the present disclosure.

Specific implementations of the display panel and the drive method thereof, and the display device provided by the embodiments of the present disclosure are described in detail below with reference to the accompanying drawings.

Large-sized display devices have larger load because they have larger screens. It is difficult to drive the entire display panel by one drive circuit (for example, implemented by a driver IC), and thus a plurality of drive circuits may be employed to drive the large-sized display device. In addition, for improving high-resolution display quality, an algorithm module configured to perform subpixel borrowing may be arranged in the drive circuit, so as to implement subpixel borrowing by borrowing between adjacent pixels.

Subpixel borrowing is typically implemented by borrowing pixels forward or backward through the pixels. When being driven by one drive circuit, the last subpixel column cannot borrow the next subpixel column. Therefore, when the drive circuit drives the last subpixel column of the display panel, the subpixel borrowing cannot be completed. In this case, the problem of occurrence of abnormal bright lines in the last column may be caused. A small-sized display screen only needs to be driven by one drive circuit, and the bright lines in the last column do not have a significant effect on the entire display. However, in the case that a plurality of drive circuits are spliced to drive a large-sized display screen, when a bright line occurs if it is impossible to implement subpixel borrowing at the joint of two adjacent drive circuits, a bright line may occur in a central region of the display screen, which may seriously have a negative effect on the display effect.

Figure 1:
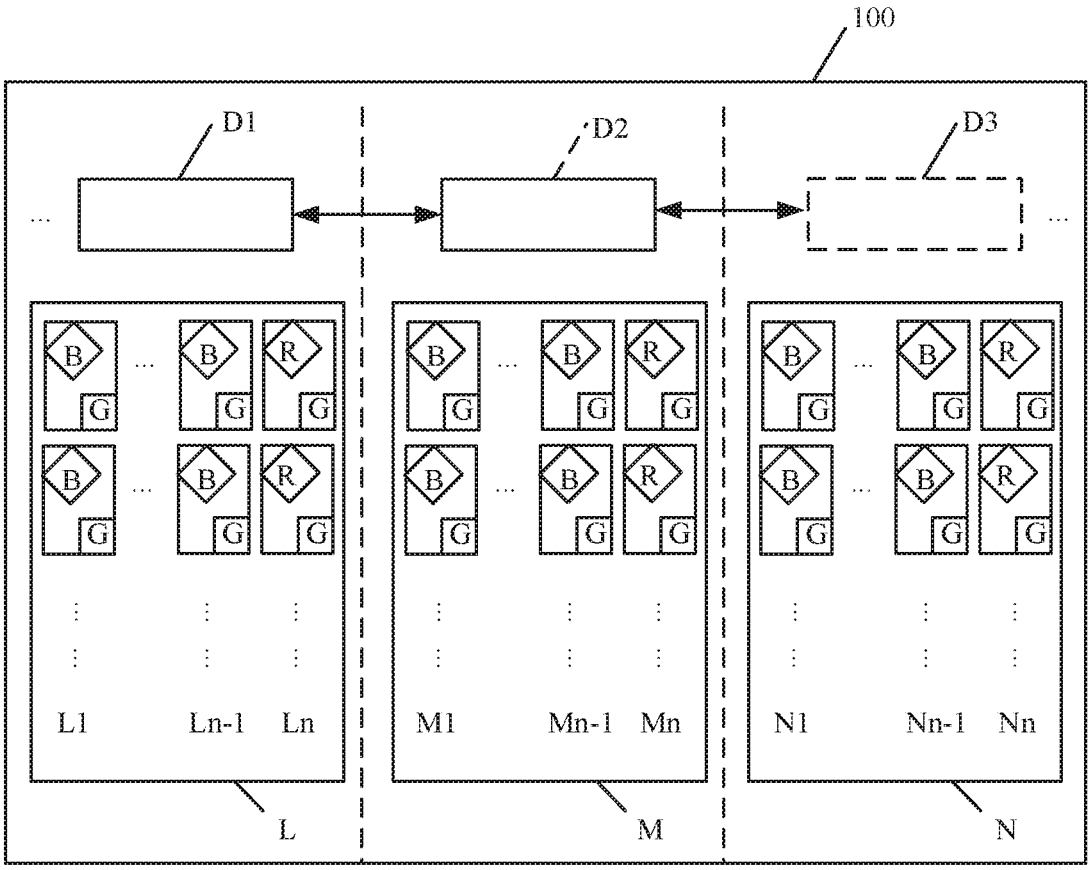
FIG. 1 illustrates a schematic structural diagram of a display panel according to an embodiment of the present disclosure.

FIG. 1 illustrates a schematic structural diagram of a display panel 100 according to an embodiment of the present disclosure. As shown in FIG. 1, the display panel may include a plurality of sets of pixel columns, for example, a first set of pixel columns L, a second set of pixel columns M, and a third set of pixel columns N, etc. Each of the sets of pixel columns may include a plurality of subpixel columns. FIG. 1 schematically illustrates a first subpixel column $L_1$, . . . , a penultimate subpixel column $L_{n-1}$ and a last subpixel column $L_n$ in the first set of pixel columns L, a first subpixel column $M_1$, . . . , a penultimate subpixel column $M_{n-1}$ and a last subpixel column $M_n$ in the second set of pixel columns M, and a first subpixel column $N_1$, . . . , a penultimate subpixel column $N_{n-1}$ and a last subpixel column $N_n$ in the third set of pixel columns N. Each of the subpixel columns may include a plurality of subpixel units. Each of the subpixel units may include at least two subpixels configured to display different colors.

The display panel may further include a plurality of drive circuits, which may correspond to the plurality of sets of pixel columns respectively and may drive the respective sets of pixel columns to display. As shown in FIG. 1, the plurality of drive circuits may include a first drive circuit D1 configured to drive the first set of pixel columns L, a second drive circuit D2 configured to drive the second set of pixel columns M, and a third drive circuit D3 configured to drive the third set of pixel columns N.

Specifically, the drive circuit may send a source data signal for the subpixel column in the set of pixel columns of the drive circuit which is adjacent to the set of pixel columns of an adjacent drive circuit to the adjacent drive circuit. For example, the second drive circuit D2 may send the source data signal for the first subpixel column $M_1$ in the second set of pixel columns M to the first drive circuit D1 which is adjacent to the first subpixel column $M_1$. In addition, for example, the second drive circuit D2 may also send the source data signal for the last subpixel column $M_n$ to the third drive circuit D3 which is adjacent to the last subpixel column $M_n$.

In addition, the drive circuit may also receive, from an adjacent drive circuit, a source data signal for the subpixel column in the set of pixel columns of the adjacent drive circuit which is adjacent to the set of pixel columns of the drive circuit, and generate a data signal for driving the subpixel column in the set of pixel columns of the drive circuit which is adjacent to the set of pixel columns of the adjacent drive circuit, based on the received source data signal. For example, the second drive circuit D2 may receive, from the first drive circuit D1, a source data signal for the last subpixel column $L_n$ in the first set of pixel columns L, and generate a data signal for driving the first subpixel column $M_1$ in the second set of pixel columns M, based on the received source data signal. In addition, for example, the second drive circuit D2 also may receive, from the third drive circuit D3, a source data signal for the first subpixel column $N_1$ in the third set of pixel columns N, and generate a data signal for driving the last subpixel column $M_n$ in the second set of pixel columns M, based on the received source data signal.

Those skilled in the art may understand that only three sets of pixel columns are schematically illustrated in this embodiment, but the number of sets of pixel columns should not be limited. According to this embodiment of the present disclosure, the display panel may include two or more sets of pixel columns.

In the display panel provided by the embodiment of the present disclosure, by way of data communication between the two drive circuits for driving adjacent sets of pixel columns, the source data signals for two adjacent subpixel columns at a joint of the two adjacent set of subpixel columns are respectively transmitted to the corresponding adjacent drive circuits, such that subpixel borrowing at the joint can be implemented. In this way, it is avoided occurrence of abnormal bright lines in a central region when the same display panel is illuminated by a plurality of drive circuits.

The data communication between two drive circuits for driving the adjacent sets of pixel columns is further described in the following embodiments.

In some embodiments of the present disclosure, the drive circuit may send, when driving the last subpixel column in the set of pixel columns of the drive circuit, the source data signal for the last subpixel column to the next adjacent drive circuit. For example, the second drive circuit D2 may send, when driving the last subpixel column $M_n$ in the second set of pixel columns M, the source data signal for the last subpixel column $M_n$ to the third drive circuit.

In another embodiment, the drive circuit also may receive, when the last subpixel column in the set of pixel columns of the previous adjacent drive circuit is being driven, a source data signal for the last subpixel column in the set of pixel columns of the previous drive circuit from the previous adjacent drive circuit, and generate a data signal for driving the first subpixel column in the set of pixel columns of the drive circuit based on the received source data signal. For example, when the last subpixel column $L_n$ in the first set of pixel columns L of the first drive circuit D1 is being driven, the second drive circuit D2 may receive, from the first drive circuit D1, a source data signal for the last subpixel column $L_n$ in the first set of pixel columns L, and generate a data signal for driving the first subpixel column $M_1$ in the second set of pixel columns M based on the received source data signal.

In some embodiments of the present disclosure, when driving the penultimate subpixel column in the set of pixel columns of the drive circuit, the drive circuit may receive, from the next adjacent drive circuit, a source data signal for the first subpixel column in the set of pixel columns of the next adjacent drive circuit, and generate a data signal for driving the last subpixel column in the set of pixel columns of the drive circuit based on the received source data signal. For example, when driving the penultimate subpixel column $M_{n-1}$ in the second set of pixel columns M, the second drive circuit D2 may receive, from the third drive circuit D3, a source data signal for the first subpixel column $N_1$ in the third set of pixel columns N, and generate a data signal for driving the last subpixel column $M_n$ in the second set of pixel columns M, based on the received source data signal.

In another embodiment, when the penultimate subpixel column in the set of pixel columns of the previous adjacent drive circuit is being driven, the drive circuit may also send a source data signal for the first subpixel column in the set of pixel columns of the drive circuit to the previous adjacent drive circuit. For example, when the penultimate subpixel column $L_{n-1}$ in the first set of pixel columns L of the first drive circuit D1 is being driven, the second drive circuit D2 may send a source data signal for the first subpixel column $M_1$ in the second set of pixel columns M to the first drive circuit D1.

FIG. 1 also schematically illustrates a pixel arrangement of the display panel. Each of the subpixel units in one of the adjacent subpixel columns includes a red subpixel and a green subpixel (for example, represented by RG), and each of the subpixel units in the other one of the adjacent subpixel columns includes a blue subpixel and a green subpixel (for example, represented by BG). The subpixel unit BG borrows a red subpixel R of the adjacent subpixel unit to form a RGB pixel. The subpixel unit RG borrows a blue subpixel B of the adjacent subpixel unit to form the RGB pixel. It is to be noted that the above pixel arrangement is only for illustration, and the above disclosure concept provided by some embodiments of the present disclosure may be applied to other display panels that satisfy pixel arrangement for borrowing subpixels, which is not limited herein.

Figure 2:
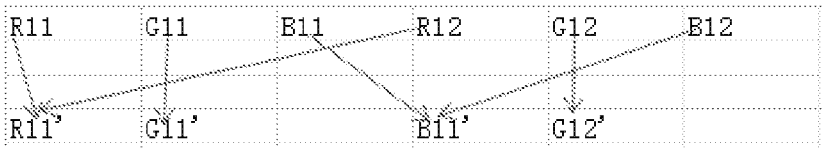
FIG. 2 illustrates a schematic diagram of example illustrating borrowing a subpixel according to an embodiment of the present disclosure.

The specific implementation process of a subpixel borrowing algorithm is to implement pixel combination by borrowing subpixels of adjacent subpixel unit. For example, the source data signal actually inputted by a system side into the drive circuit to perform subpixel borrowing is RGBRGB . . . . However, the pixel arrangement of the display panel is RGBGRGBG . . . as shown in FIG. 1, and thus the subpixel unit BG borrows R of a next subpixel unit to form a RGB pixel, and the subpixel unit RG borrows B of the next subpixel unit to form the RGB pixel. FIG. 2 illustrates a mapping mode in subpixel borrowing. As shown in FIG. 2, the inputted R11 and R12 are mapped to the display panel to form R11', by way of data communication and borrowing algorithm. G11 is mapped to the display panel to form G11', by way of data communication and borrowing algorithm. B11 and B12 are mapped to the display panel to form B11', by way of data communication and borrowing algorithm. G12 is mapped to the display panel to form G12', by way of data communication and borrowing algorithm. By analogy, borrowing of subpixels is implemented, wherein a specific algorithm formula thereof is as below:

$$R'_{ni}=(((R_{ni})^{2.2}+(R_{n(i+1)})^{2.2})/2)^{1/2.2};$$

$$G'_{ni}=G_{ni};$$

$$B'_{ni}=(((B_{ni})^{2.2}+(Bn_{(i+1)})^{2.2})/2)^{1/2.2}; \text{ and}$$

$$G'_{n(i+1)}=G_{n(i+1)};$$

wherein n=1, 2, 3, 4, 5, 6 . . . , which represents a row number, i=1, 2, 3, 4, 5, 6 . . . , which represents a serial number of the pixel column in which the subpixel unit is positioned, R, G and B represent source data signals received by the drive circuit, and R', G', B' represent data signals used by the drive circuit to drive the subpixel unit to display. The above formula is for a pixel arrangement of BGRG . . . . Different pixel arrangements have subtle differences in algorithm formula, but their basic ideas of borrowing do not change, and thus are not described in detail herein.

In some embodiments of the present disclosure, the drive circuit may further include at least one serial communication interface. The source data signal is transmitted between the drive circuits adjacent to each other via the serial communication interface. For example, the drive circuit may send, via the serial communication interface, a source data signal for the first subpixel column in the set of pixel columns of the drive circuit to the previous adjacent drive circuit.

In some embodiments of the present disclosure, the drive circuit may further include a line buffer. The line buffer may store the source data signal received via the serial communication interface. Specifically, two adjacent drive circuits may implement data communication via the serial communication interface, and may store, via the line buffer, the source data signal transmitted by the serial communication interface. Borrowing a subpixel at a joint may be implemented by using the source data signal received via the serial communication interface. When borrowing the subpixel, the data signal stored in the line buffer may be invoked.

As mentioned above, the display panel according to some embodiments of the present disclosure may prevent occurrence of bright lines in a central region of a display screen when the display panel is driven by a plurality of drive circuits to display.

In another aspect, an embodiment of the present disclosure also provides a method for driving a display panel, which is described in detail below.

Figure 3:
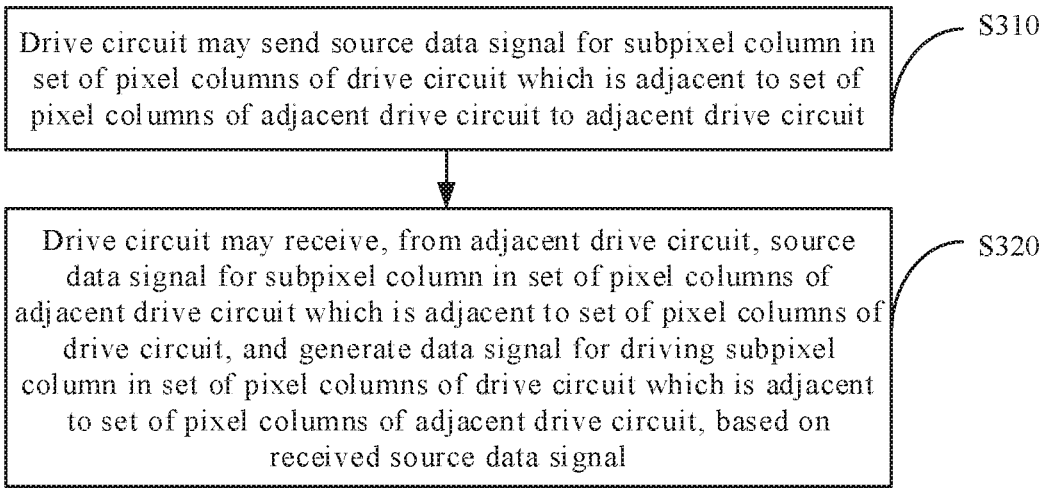
FIG. 3 illustrates a flowchart of a method for driving a display panel according to an embodiment of the present disclosure.

FIG. 3 illustrates a schematic flowchart of the method for driving the display panel according to this embodiment of the present disclosure. The display panel may be, for example, the above-described display panel.

In Step S310, the drive circuit may send a source data signal for the subpixel column in the set of pixel columns of the drive circuit which is adjacent to the set of pixel columns of an adjacent drive circuit to the adjacent drive circuit.

In some embodiments, the drive circuit may send, when driving the last subpixel column in the set of pixel columns of the drive circuit, the source data signal for the last subpixel column to the next adjacent drive circuit.

In some other embodiments, when the penultimate subpixel column in the set of pixel columns of the previous adjacent drive circuit is being driven, the drive circuit may send a source data signal for the first subpixel column in the set of pixel columns of the drive circuit to the previous adjacent drive circuit.

In Step S320, the drive circuit may receive, from an adjacent drive circuit, a source data signal for the subpixel column in the set of pixel columns of the adjacent drive circuit which is adjacent to the set of pixel columns of the drive circuit, and generate a data signal for driving the subpixel column in the set of pixel columns of the drive circuit which is adjacent to the set of pixel columns of the adjacent drive circuit, based on the received source data signal.

In some embodiments, when driving the penultimate subpixel column in the set of pixel columns of the drive circuit, the drive circuit may receive, from the next adjacent drive circuit, a source data signal for the first subpixel column in the set of pixel columns of the next adjacent drive circuit, and generate a data signal for driving the last subpixel column in the set of pixel columns of the drive circuit based on the received source data signal.

In some other embodiments, when the last subpixel column in the set of pixel columns of the previous adjacent drive circuit is being driven, the drive circuit may receive, from the previous adjacent drive circuit, a source data signal for the last subpixel column in the set of pixel columns of the previous drive circuit, and generate a data signal for driving the first subpixel column in the set of pixel columns of the drive circuit based on the received source data signal.

As mentioned above, by way of data communication between two adjacent drive circuits, source data signals of two adjacent subpixel columns at a joint can be respectively transmitted to the corresponding drive circuit to perform subpixel borrowing at the joint, thereby driving the subpixel unit at the joint to display. In this way, borrowing a subpixel unit may be implemented at the joint of the two adjacent drive circuit, thereby solving the problem of occurrence of abnormal bright lines in a central region when the display panel is illuminated by a plurality of drive circuits.

In some embodiments of the present disclosure, the source data signal may be transmitted between the drive circuits adjacent to each other via a serial communication interface.

In some embodiments of the present disclosure, the source data signal is transmitted between the drive circuits adjacent to each other via the serial communication interface under the control of a line synchronization signal.

In another aspect, an embodiment of the present disclosure further provides a display device. The display device may include the foregoing display panel provided by some embodiments of the present disclosure. The display device may be employed in any product or component having a display function, such as mobile phone, a tablet computer, a TV set, a display, a notebook computer, a digital photo frame, a navigation device, and so on.

A plurality of embodiments of the present disclosure are described in detail above. However, scope of protection of the present disclosure is not limited thereto. Apparently, those of ordinary skill in the art may make various modifications, substitutions, and variations on the embodiments of the present disclosure without departing from the spirit and scope of the present disclosure. The scope of protection of the present disclosure is limited by the appended claims.

What is claimed is:

1. A display panel comprising:

a plurality of sets of pixel columns, wherein each of the sets of pixel columns comprises a plurality of subpixel columns, wherein each of the subpixel columns comprises a plurality of subpixel units, and wherein each of the subpixel units comprises at least two subpixels configured to display different colors; and a plurality of drive circuits, wherein the plurality of drive circuits correspond to the plurality of sets of pixel columns respectively and are configured to drive the respective sets of pixel columns to display;

wherein each of the drive circuits is further configured to at least one of:

send, to an adjacent drive circuit, a source data signal for the subpixel column in the set of pixel columns of the drive circuit which is adjacent to the set of pixel columns of the adjacent drive circuit, and receive, from the adjacent drive circuit, a source data signal for the subpixel column in the set of pixel columns of the adjacent drive circuit which is adjacent to the set of pixel columns of the drive circuit, and generate a data signal for driving the subpixel column in the set of pixel columns of the drive circuit which is adjacent to the set of pixel columns of the adjacent drive circuit, based on the received source data signal;

wherein the drive circuit is further configured to at least one of:

receive, when driving the penultimate subpixel column in the set of pixel columns of the drive circuit, a source data signal for the first subpixel column in the set of pixel columns of the next adjacent drive circuit from the next adjacent drive circuit, and generate a data signal for driving the last subpixel column in the set of pixel columns of the drive circuit based on the received source data signal; and send, when the penultimate subpixel column in the set of pixel columns of the previous adjacent drive circuit is being driven, a source data signal for the first subpixel column in the set of pixel columns of the drive circuit to the previous adjacent drive circuit.

2. The display panel according to claim 1, wherein the drive circuit is further configured to at least one of:

send, when driving the last subpixel column in the set of pixel columns of the drive circuit, the source data signal for the last subpixel column to the next adjacent drive circuit; and receive, when the last subpixel column in the set of pixel columns of the previous adjacent drive circuit is being driven, a source data signal for the last subpixel column in the set of pixel columns of the previous drive circuit from the previous adjacent drive circuit, and generate a data signal for driving the first subpixel column in the set of pixel columns of the drive circuit based on the received source data signal.

3. The display panel according to claim 2, wherein the drive circuit comprises at least one serial communication interface, and wherein the source data signal is transmitted between the drive circuits adjacent to each other via the serial communication interface.

4. The display panel according to claim 2, wherein each of the subpixel units in one of the adjacent subpixel columns comprises a red subpixel and a green subpixel, and wherein each of the subpixel units in the other one of the adjacent subpixel columns comprises a blue subpixel and a green subpixel.

5. The display panel according to claim 1, wherein the drive circuit comprises at least one serial communication interface, and wherein the source data signal is transmitted between the drive circuits adjacent to each other via the serial communication interface.

6. The display panel according to claim 5, wherein the drive circuit further comprises a line buffer, and wherein the line buffer is configured to store the source data signal received via the serial communication interface.

7. The display panel according to claim 5, wherein each of the subpixel units in one of the adjacent subpixel columns comprises a red subpixel and a green subpixel, and wherein each of the subpixel units in the other one of the adjacent subpixel columns comprises a blue subpixel and a green subpixel.

8. The display panel according to claim 6, wherein each of the subpixel units in one of the adjacent subpixel columns comprises a red subpixel and a green subpixel, and wherein each of the subpixel units in the other one of the adjacent subpixel columns comprises a blue subpixel and a green subpixel.

9. The display panel according to claim 1, wherein each of the subpixel units in one of the adjacent subpixel columns comprises a red subpixel and a green subpixel, and wherein each of the subpixel units in the other one of the adjacent subpixel columns comprises a blue subpixel and a green subpixel.

10. A display device comprising the display panel according to claim 1.

11. The display device according to claim 10, wherein a drive circuit in the display panel is further configured to at least one of:

send, when driving the last subpixel column in the set of pixel columns of the drive circuit, the source data signal for the last subpixel column to the next adjacent drive circuit; and receive, when the last subpixel column in the set of pixel columns of the previous adjacent drive circuit is being driven, a source data signal for the last subpixel column in the set of pixel columns of the previous drive circuit from the previous adjacent drive circuit, and generate a data signal for driving the first subpixel column in the set of pixel columns of the drive circuit based on the received source data signal.

12. The display device according to claim 10, wherein a drive circuit in the display panel is further configured to at least one of:

receive, when driving the penultimate subpixel column in the set of pixel columns of the drive circuit, a source data signal for the first subpixel column in the set of pixel columns of the next adjacent drive circuit from the next adjacent drive circuit, and generate a data signal for driving the last subpixel column in the set of pixel columns of the drive circuit based on the received source data signal; and send, when the penultimate subpixel column in the set of pixel columns of the previous adjacent drive circuit is being driven, a source data signal for the first subpixel column in the set of pixel columns of the drive circuit to the previous adjacent drive circuit.

13. The display panel according to claim 1, wherein the drive circuit comprises at least one serial communication interface, and wherein the source data signal is transmitted between the drive circuits adjacent to each other via the serial communication interface.

14. The display panel according to claim 1, wherein each of the subpixel units in one of the adjacent subpixel columns comprises a red subpixel and a green subpixel, and wherein each of the subpixel units in the other one of the adjacent subpixel columns comprises a blue subpixel and a green subpixel.

15. A method for driving the display panel according to claim 1, the method comprising at least one of:

for each of a plurality of drive circuits, sending, by the drive circuit, a source data signal for the subpixel column in the set of pixel columns of the drive circuit which is adjacent to the set of pixel columns of an adjacent drive circuit to the adjacent drive circuit; and receiving, by the drive circuit, a source data signal for the subpixel column in the set of pixel columns of the adjacent drive circuit which is adjacent to the set of pixel columns of the drive circuit from the adjacent drive circuit, and generating a data signal for driving the subpixel column in the set of pixel columns of the drive circuit which is adjacent to the set of pixel columns of the adjacent drive circuit, based on the received source data signal;

wherein receiving, by the drive circuit, a source data signal for the subpixel column in the set of pixel columns of the adjacent drive circuit which is adjacent to the set of pixel columns of the drive circuit from the adjacent drive circuit, and generating a data signal for driving the subpixel column in the set of pixel columns of the drive circuit which is adjacent to the set of pixel columns of the adjacent drive circuit, based on the received source data signal comprise at least one of:

receiving, by the drive circuit, when driving the penultimate subpixel column in the set of pixel columns of the drive circuit, a source data signal for the first subpixel column in the set of pixel columns of the next adjacent drive circuit from the next adjacent drive circuit, and generating a data signal for driving the last subpixel column in the set of pixel columns of the drive circuit based on the received source data signal; and receiving, by the drive circuit, when the last subpixel column in the set of pixel columns of the previous adjacent drive circuit is being driven, a source data signal for the last subpixel column in the set of pixel columns of the previous drive circuit from the previous adjacent drive circuit, and generating a data signal for driving the first subpixel column in the set of pixel columns of the drive circuit based on the received source data signal.

16. The method according to claim 15, wherein sending, by the drive circuit, a source data signal for the subpixel column in the set of pixel columns of the drive circuit which is adjacent to the set of pixel columns of an adjacent drive circuit to the adjacent drive circuit comprises at least one of:

sending, by the drive circuit, when driving the last subpixel column in the set of pixel columns of the drive circuit, the source data signal for the last subpixel column to the next adjacent drive circuit; and sending, by the drive circuit, when the penultimate subpixel column in the set of pixel columns of the previous adjacent drive circuit is being driven, a source data signal for the first subpixel column in the set of pixel columns of the drive circuit to the previous adjacent drive circuit.

17. The drive method according to claim 15, wherein the source data signal is transmitted between the drive circuits adjacent to each other via a serial communication interface.

18. The drive method according to claim 17, wherein the source data signal is transmitted between the drive circuits adjacent to each other via the serial communication interface under the control of a line synchronization signal.

* * * * *